US005623407A

United States Patent [19]

Brooks

[11] Patent Number: 5,623,407

[45] Date of Patent: Apr. 22, 1997

[54] METHOD OF CORRECTING AXIAL AND TRANSVERSE ERROR COMPONENTS IN MAGNETOMETER READINGS DURING WELLBORE SURVEY OPERATIONS

[75] Inventor: Andrew G. Brooks, Tomball, Tex.

[73] Assignee: Baker Hughes Incorporated, Houston, Tex.

[21] Appl. No.: 478,165

[22] Filed: Jun. 7, 1995

[51] Int. Cl.[6] ..... E21B 47/022

[52] U.S. Cl. ..... 364/422; 364/559; 364/571.01

[58] Field of Search ..... 33/304, 313, 356, 33/361, 355 R; 324/346, 244, 245; 175/40, 45; 73/151; 166/66.5; 340/853.5

[56] References Cited

U.S. PATENT DOCUMENTS

| | | | |
|---|---|---|---|
| 4,163,324 | 8/1979 | Russell et al. | 33/313 |
| 4,345,454 | 8/1982 | Brown | 33/313 |
| 4,761,889 | 8/1988 | Cobern et al. | 33/312 |
| 4,956,921 | 9/1990 | Coles | 33/304 |
| 5,103,177 | 4/1992 | Russell et al. | 324/346 |
| 5,321,893 | 6/1994 | Engebretson | 33/304 |
| 5,432,699 | 7/1995 | Hache et al. | 364/422 |
| 5,452,518 | 9/1995 | DiPersio | 33/304 |

*Primary Examiner*—Edward R. Cosimano
*Assistant Examiner*—Craig Steven Miller
*Attorney, Agent, or Firm*—Melvin A. Hunn

[57] ABSTRACT

The present invention is directed to a method for compensating V2 for bias error on one or more magnetometers used for one or more borehole directional surveys, comprising determining the constant or first-order varying bias values which minimize the variance of computed local magnetic field vectors with respect to central values, which may be either independent estimates of the local magnetic field vector or the mean values of the computed local magnetic field vectors.

21 Claims, 12 Drawing Sheets

METHOD OF CORRECTING AXIAL AND TRANSVERSE ERROR COMPONENTS IN MAGNETOMETER READINGS DURING WELLBORE SURVEY OPERATIONS

BACKGROUND OF THE INVENTION

1. Field of the Invention:

Surveying of wellbore orientation is commonly performed by the use of instruments containing sets of three orthogonal accelerometers and magnetometers, which are inserted within the drillstring and used to measure the orientations of the local gravitational and magnetic field vectors. In order to measure the earth's magnetic field, which is used as a north reference from which wellbore azimuth may be computed, the instruments must be placed within a section of non-magnetic material extending between upper and lower ferromagnetic drillstring sections. These ferromagnetic portions of the drillstring tend to acquire magnetization as they are repeatedly strained in the earth's magnetic field during drilling operations. The nominally non-magnetic portion of the drillstring may also acquire some lesser magnetization as a result of imperfections. The result is that magnetometer measurements made by an instrument within a drillstring may measure not the undisturbed magnetic field, but the vector sum of the earth's field and an error field caused by drillstring magnetization. Since the tool is fixed with respect to the drillstring, the error field is fixed with respect to the tool's coordinate system and it appears as bias errors on the magnetometer measurements, which can lead to errors in the determination of wellbore azimuth and trajectory unless measures are taken to compensate for these bias errors.

2. Description of the Prior Art:

Since the greater part of the drillstring magnetization occurs in the ferromagnetic portions of the drillstring, which are displaced axially from the instrument, the bias error in the axial direction usually exceeds the transverse bias errors. Various methods have therefore been published which seek to determine axial magnetometer bias errors in a single directional survey, including U.S. Pat. Nos. 3,791,043 to Russell, 4,163,324 to Russell, U.S. Pat. No. Re. 33,708 to Roesler, 4,761,889 to Cobern, 4,819,336 to Russell, 4,999,920 to Russell, and 5,155,916 to Engebretson. All of these methods require the provision of an independent estimate of one or more components of the earth's magnetic field, and as a result all of them tend to lose accuracy in those attitudes in which the direction of the independent estimate is perpendicular to the drillstring and therefore contributes little or no axial information. In particular, all of these methods lose accuracy as the wellbore attitude approaches horizontal east-west. A number of methods have also been published which seek to determine magnetometer biases on all three axes, including U.S. Pat. Nos. 4,682,421 to van Dongen and 4,956,921 to Coles, and UK Pat. No. 2,256,492 to Nicolle. While certain of these methods can resolve transverse bias components without external estimates of the field, they all require an independent estimate of the earth's magnetic field in order to determine the axial bias component, and therefore they also tend to lose accuracy as the attitude approaches horizontal east-west. U.S. Pat. No. 4,709,486 to Walters discloses a method for determining axial bias errors without any external estimate, by the simultaneous use of transverse magnetometer data from a plurality of surveys. However the method fails to make use of the valuable information contained in the axial magnetometer measurements, since it does not require any correlation between the axial biases determined at the two locations. In U.S. Pat. No. 5,321,893, Engebretson discloses a method which may be used to determine magnetometer scale factor and bias errors from a plurality of surveys with or without requiring any external estimate of the earth's field. However, the method is inherently approximate since it requires the construction of a "measurement matrix", whose elements depend on the unknown borehole attitude and magnetic dip angle.

Additional objectives, features and advantages of the present invention will be apparent in the written description which follows.

SUMMARY OF THE INVENTION

It is therefore an objective of the present invention to provide a method for determining magnetometer biases during wellbore survey operations, which is capable of determining biases on up to three axes, with or without the use of an external estimate of the local magnetic field, and which is capable of providing an accurate result using data from a minimum number of surveys. Since drillstring magnetization may be acquired or lost during the course of the drilling operation, it is a further object of the present invention to provide a method for determining magnetometer biases which may vary between surveys in a predefined manner.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
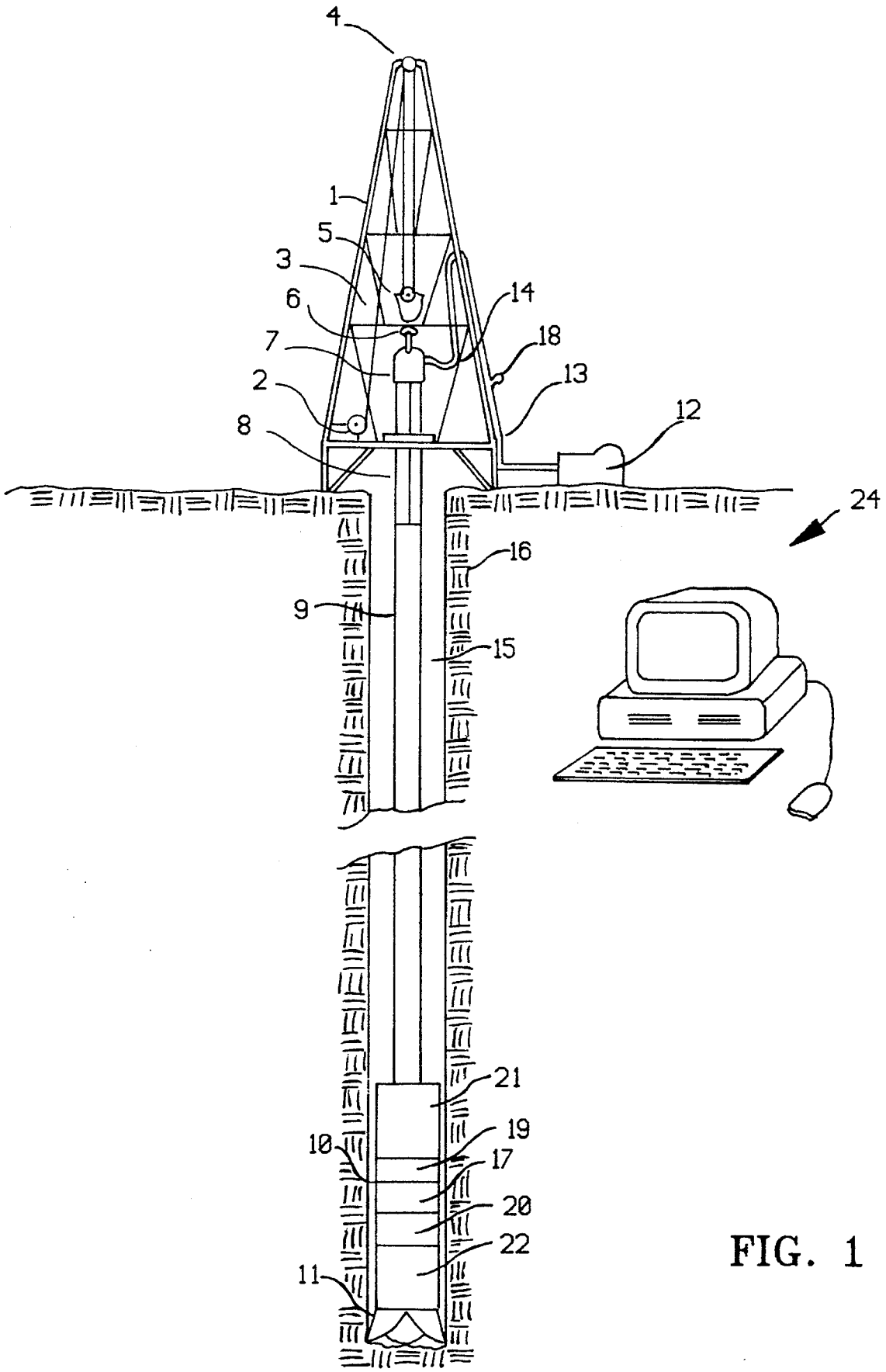
FIG. 1 shows a typical drilling operation comprising a drilling rig, a drillstring including a survey instrument, and a fluid circulating system.
Figure 2A:
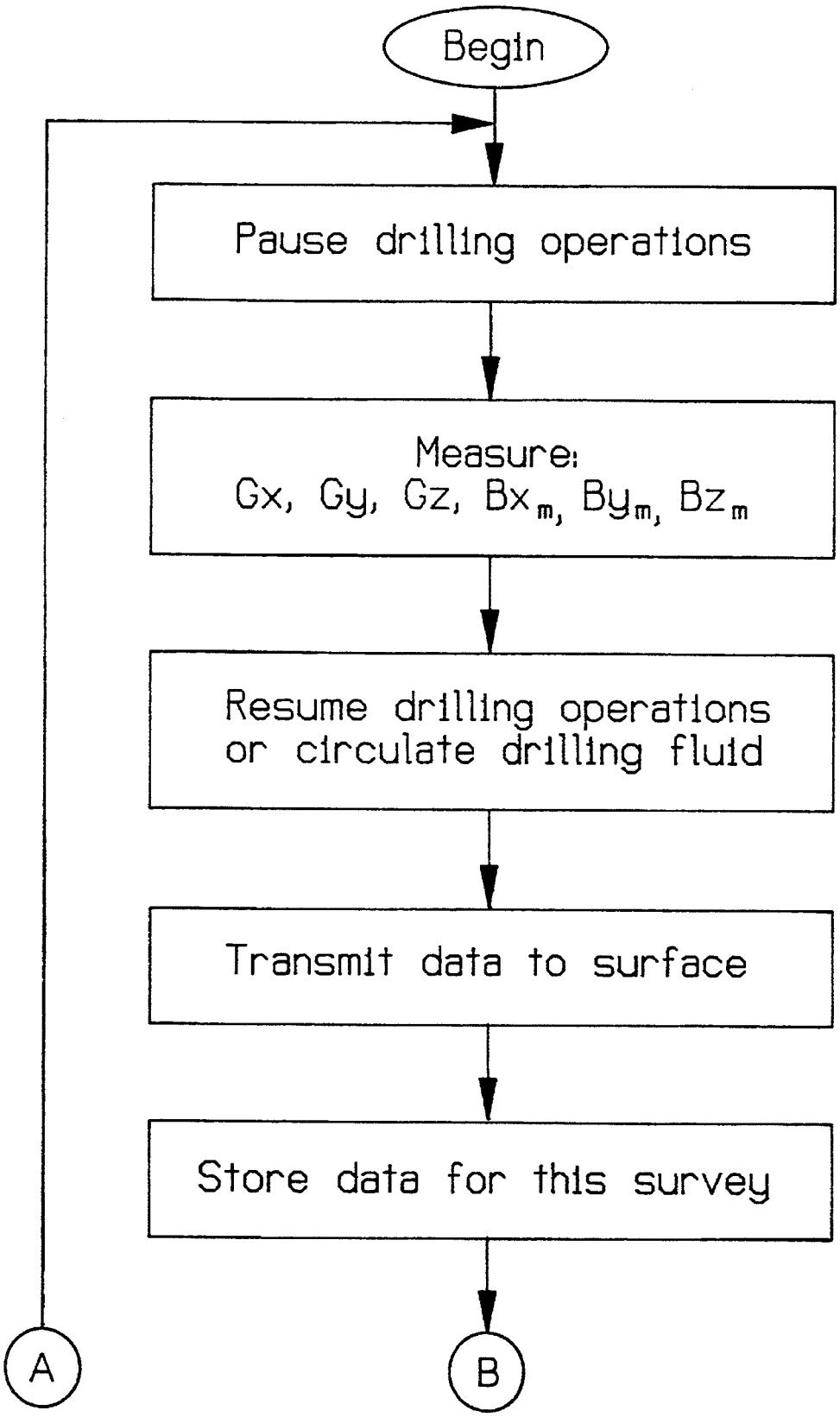
FIG. 2 shows a flowchart illustrating the typical acquisition of survey data at a number of survey stations.
Figure 2B:
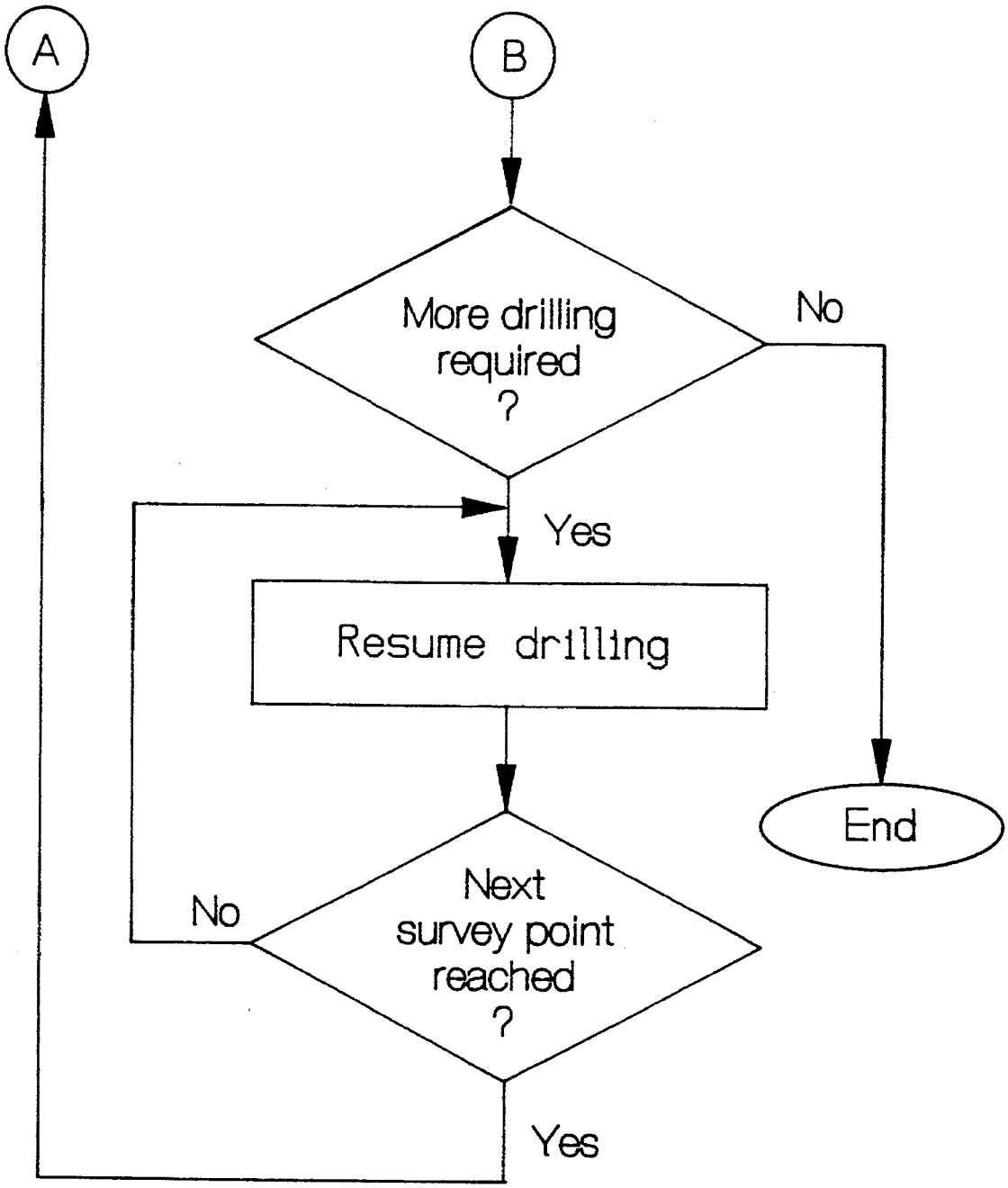

FIG. 1 illustrates a rig engaged in drilling operations; the equipment includes a derrick 1, drawworks 2, cable 3, crown block 4, traveling block 5, and hook 6, supporting a drillstring which includes a swivel joint 7, kelly 8, drillpipe 9, drill collars 10, and drill bit 11. Pumps 12 circulate drilling fluid through a standpipe 13 and flexible hose 14, down through the hollow drillstring and back to the surface through the annular space 15 between the drillstring and the borehole wall 16. During the course of drilling a borehole for oil or gas exploration, it is advantageous to measure from time to time the orientation of the borehole in order to determine its trajectory. This can be accomplished by the use of a survey tool 17 located within the drill collars 10, for measuring the direction and magnitude of the local gravitational and magnetic fields with respect to a tool-fixed coordinate system. It is customary to take one survey each time the drilling operation is interrupted to add a new section to the drillstring; however, surveys can be taken at any time as indicated in the flowchart of FIG. 2. Referring again to FIG. 1, the measured data are transmitted to the surface by modulating a valve (not shown) placed in the flow passage within or adjacent to survey tool 17, causing pressure pulses to propagate in the mud column up the drillstring, where they are detected by a pressure transducer 18 placed in the standpipe 13 and communicated to data processing system 24 which may be located on the rig floor or in a logging trailer or other work area, which is approximately programmed to (1) to interpret the pressure pulses (2) eliminate the influence of magnetic field bias error components and (3) calculate one or more conventional wellbore orientation indicators. Data processing system 24 may be programmed in accordance with the present invention.

The borehole inclination can be determined by use of the gravitational measurements alone, while the borehole azimuth is determined from the gravitational and magnetic measurements; since the azimuth uses the direction of the local magnetic field as a north reference, it is necessary for the survey tool 17 to be placed in non-magnetic portions 19 and 20 of the drillstring situated between upper and lower ferromagnetic sections 21 and 22. Magnetization of the upper and lower ferromagnetic sections 21 and 22, as well as imperfections in the non-magnetic materials comprising the survey tool 17 and the non-magnetic collars 19 and 20 can produce a magnetic error field, which is fixed in the tool's frame of reference and which therefore appears as bias errors affecting the magnetic measurements. The present invention is directed to determining these errors in order to compensate for their presence and thus to provide more accurate measurements of borehole azimuth.

Figure 3:
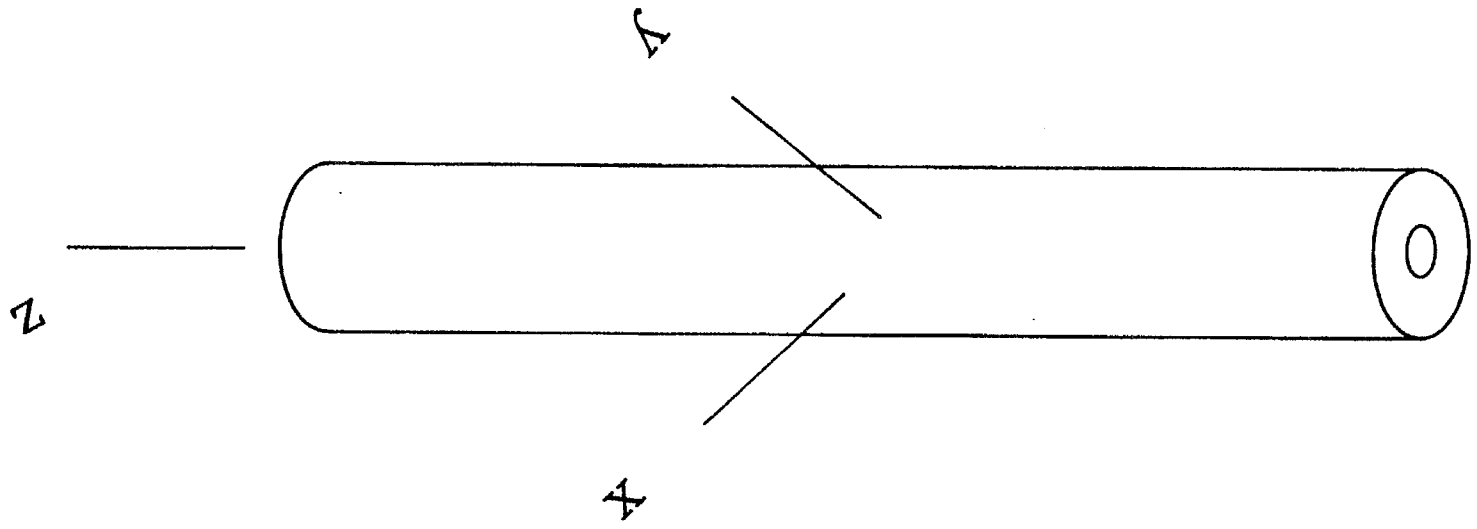
FIG. 3 shows a typical tool-fixed coordinate system used by a magnetic survey instrument located within a drillstring.

The invention will first be described as it pertains to solving for constant bias errors along each axis. It is conventional to define the tool-fixed coordinates as x,y and z, the z-coordinate being aligned with the drillstring axis as illustrated in FIG. 3. The instrument measures three components Gx, Gy and Gz of the gravitational vector G, and three components Bx, By and Bz of the magnetic field vector B. The influence of drillstring magnetization may therefore be described as bias errors $\epsilon_x$, $\epsilon_y$, and $\epsilon_z$ affecting the measured components $Bx_m$, $By_m$ and $Bz_m$ of the earth's field, thus:

$$Bx_m=Bx+\epsilon_x \tag{1}$$

$$By_m=By+\epsilon_y \tag{2}$$

$$Bz_m=Bz+\epsilon_z \tag{3}$$

Figure 4:
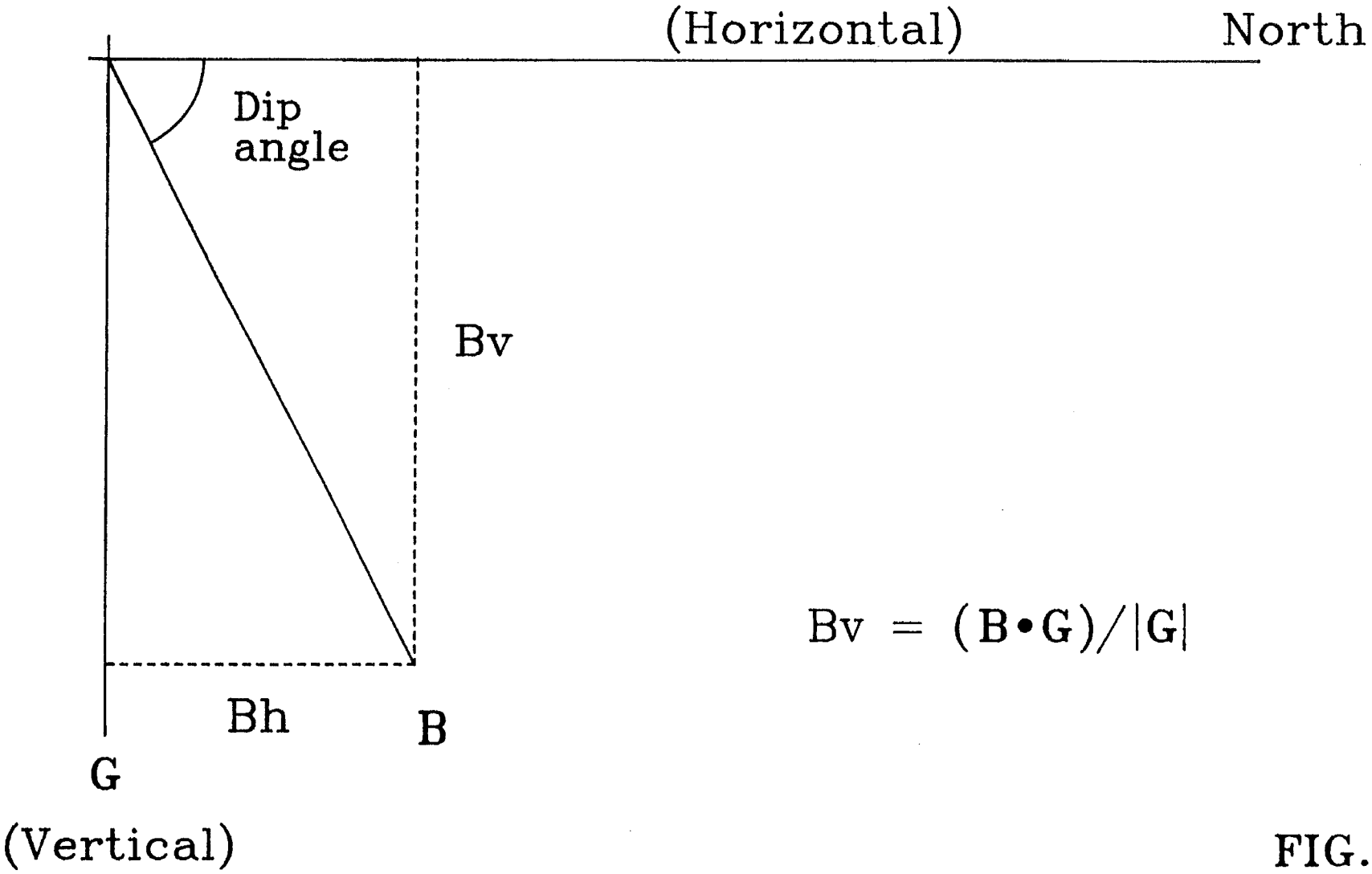
FIG. 4 shows a typical relationship between magnetic and gravitational vectors in the Northern hemisphere.

The procedure of the present invention requires initial values for $\epsilon_x$, $\epsilon_y$, and $\epsilon_z$. Initial estimates for the small transverse biases $\epsilon_x$ and $\epsilon_y$ will normally be zero or the values obtained from a previous computation, while the estimate for the axial bias $\epsilon_z$ may either be zero, the value obtained from a previous computation, or a value obtained by an alternative method such as that of Cobern U.S. Pat. No. 4,761,889, incorporated herein by reference, or other alternative prior art methods, all of which can be considered to be "independent" of the immediate calculations. Further computations are performed in an iterative loop using corrected magnetic components $Bx_c$, $By_c$, and $Bz_c$, defined by:

$$Bx_c=Bx_m-\epsilon_x \tag{4}$$

$$By_c=By_m-\epsilon_y \tag{5}$$

$$Bz_c=Bz_m-\epsilon_z \tag{6}$$

in which $\epsilon_x$, $\epsilon_y$, and $\epsilon_z$ represent the current estimates of the bias errors. It is apparent from FIG. 4 that the instrument can be used to determine the vertical and horizontal components of the magnetic field vector, using the vector dot product relationship:

$$Bv_c=(Bx_c*Gx+By_c*Gy+Bz_c*Gz)/|G| \tag{7}$$

and the vector sum relationship:

$$Bh_c=(Bx_c^2+By_c^2+Bz_c^2-Bv_c^2)^{0.5} \tag{8}$$

Figure 5:
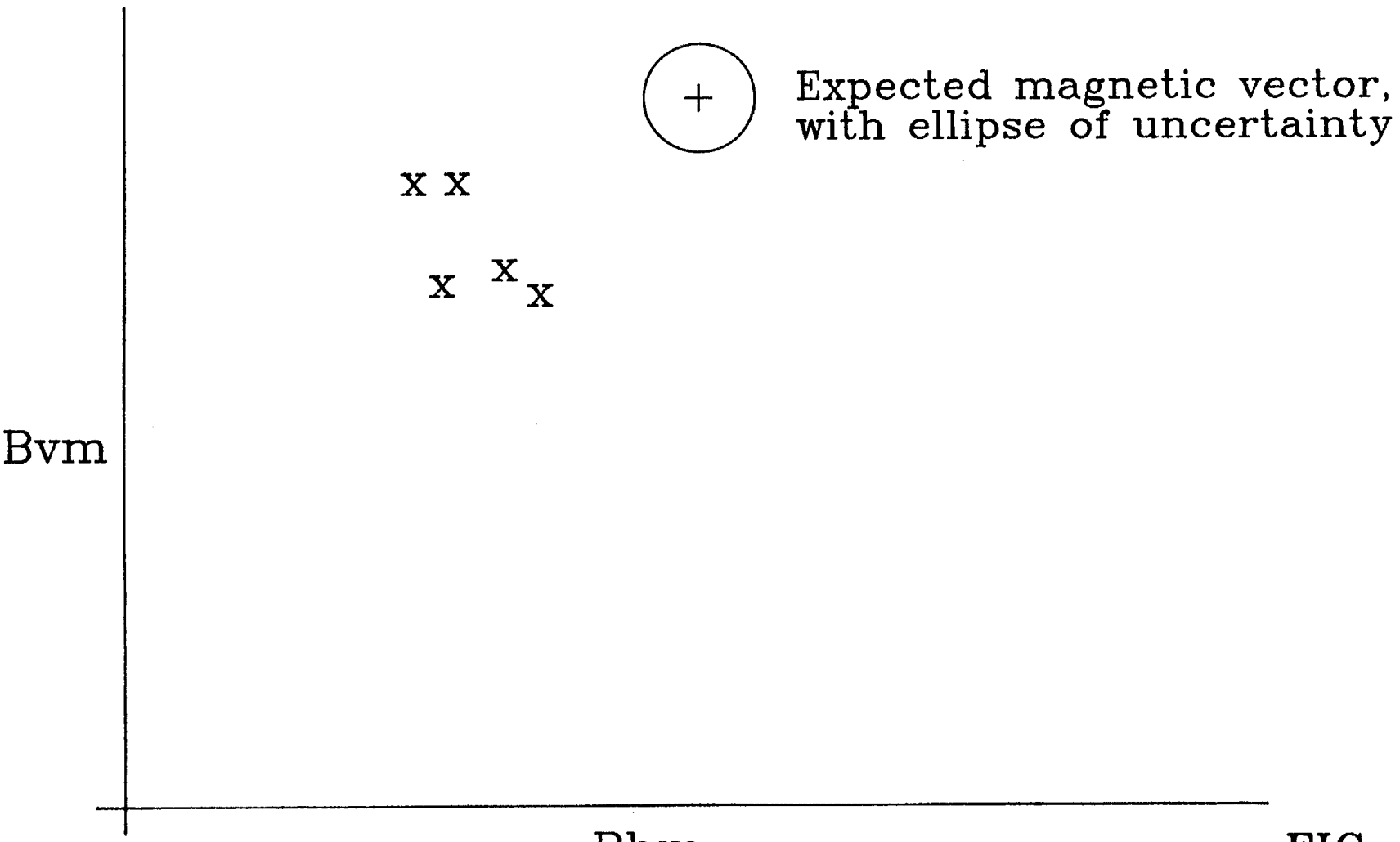
FIG. 5 shows typical measured values of the local magnetic vector, with drillstring magnetization.

Values for $Bv_c$ and $Bh_c$ as obtained from a number of surveys N will typically exhibit some scatter as shown in FIG. 5, reflecting the varying direction of the residual uncompensated error components. The invention seeks to minimize this scatter by minimizing the variance $\Sigma L^2$ of the computed components $Bv_c$ and $Bh_c$ with respect to central values $Bv_0$ and $Bh_0$. The objective is therefore to minimize the variance function:

$$\Sigma L^2=\Sigma[(Bh_c-Bh_0)^2+(Bv_c-Bv_0)^2] \tag{9}$$

where $\Sigma$ indicates summation over all N surveys.

This can be accomplished by differentiating Equation 9 with respect to the unknowns $\epsilon_x$, $\epsilon_y$, and $\epsilon_z$, and setting the results to zero:

$$F(\epsilon_x, \epsilon_y, \epsilon_z)=\Sigma[(Bh_c-Bh_0)*(\partial Bh_c/\partial\epsilon_x-\partial Bh_0/\partial\epsilon_x)+(Bv_c-Bv_0)*(\partial Bv_c/\partial\epsilon_x-\partial Bv_0/\partial\epsilon_x)]=0 \tag{10}$$

$$G(\epsilon_x, \epsilon_y, \epsilon_z)=\Sigma[(Bh_c-Bh_0)*(\partial Bh_c/\partial\epsilon_y-\partial Bh_0/\partial\epsilon_y)+(Bv_c-Bv_0)*(\partial Bv_c/\partial\epsilon_y-\partial Bv_0/\partial\epsilon_y)]=0 \tag{11}$$

$$H(\epsilon_x, \epsilon_y, \epsilon_z)=\Sigma[(Bh_c-Bh_0)*(\partial Bh_c/\partial\epsilon_z-\partial Bh_0/\partial\epsilon_z)+(Bv_c-Bv_0)*(\partial Bv_c/\partial\epsilon_z-\partial Bv_0/\partial\epsilon_z)]=0 \tag{12}$$

Figure 6:
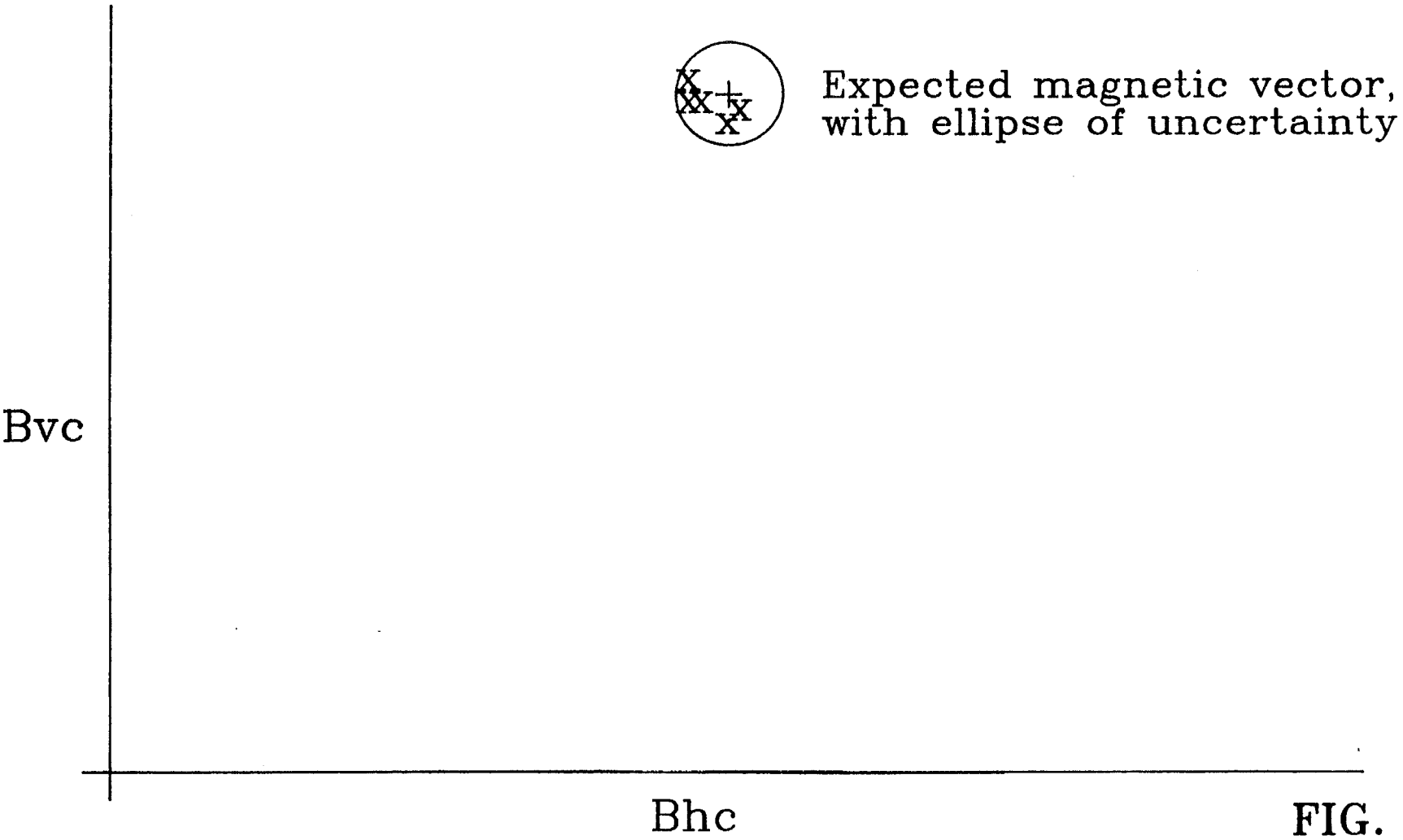
FIG. 6 shows typical corrected values of the local magnetic vector.
Figure 7A:
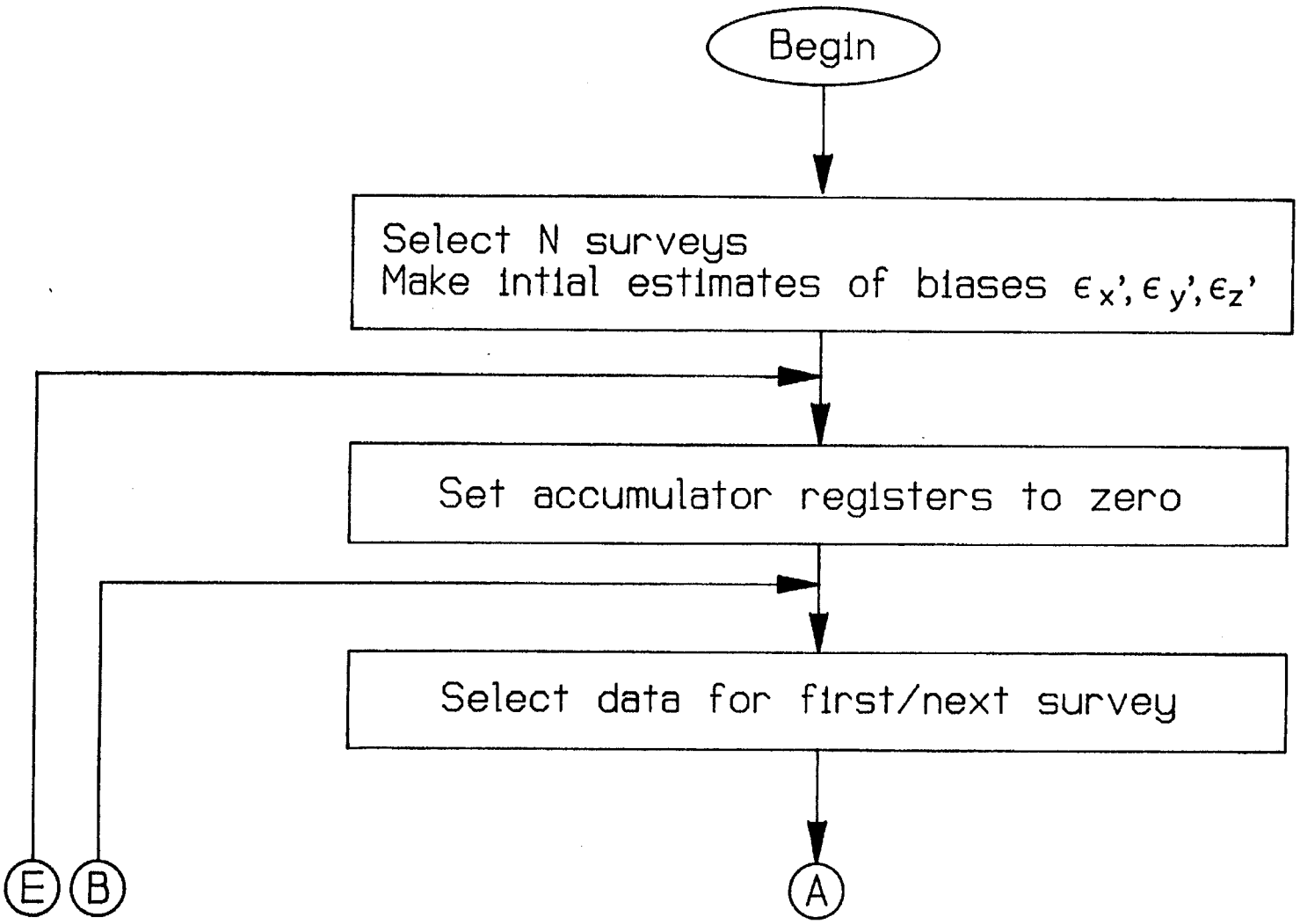
FIG. 7 shows a flowchart illustrating computation of constant bias errors on three axes by minimizing variance of the computed magnetic field vector about a mean value.
Figure 7B:
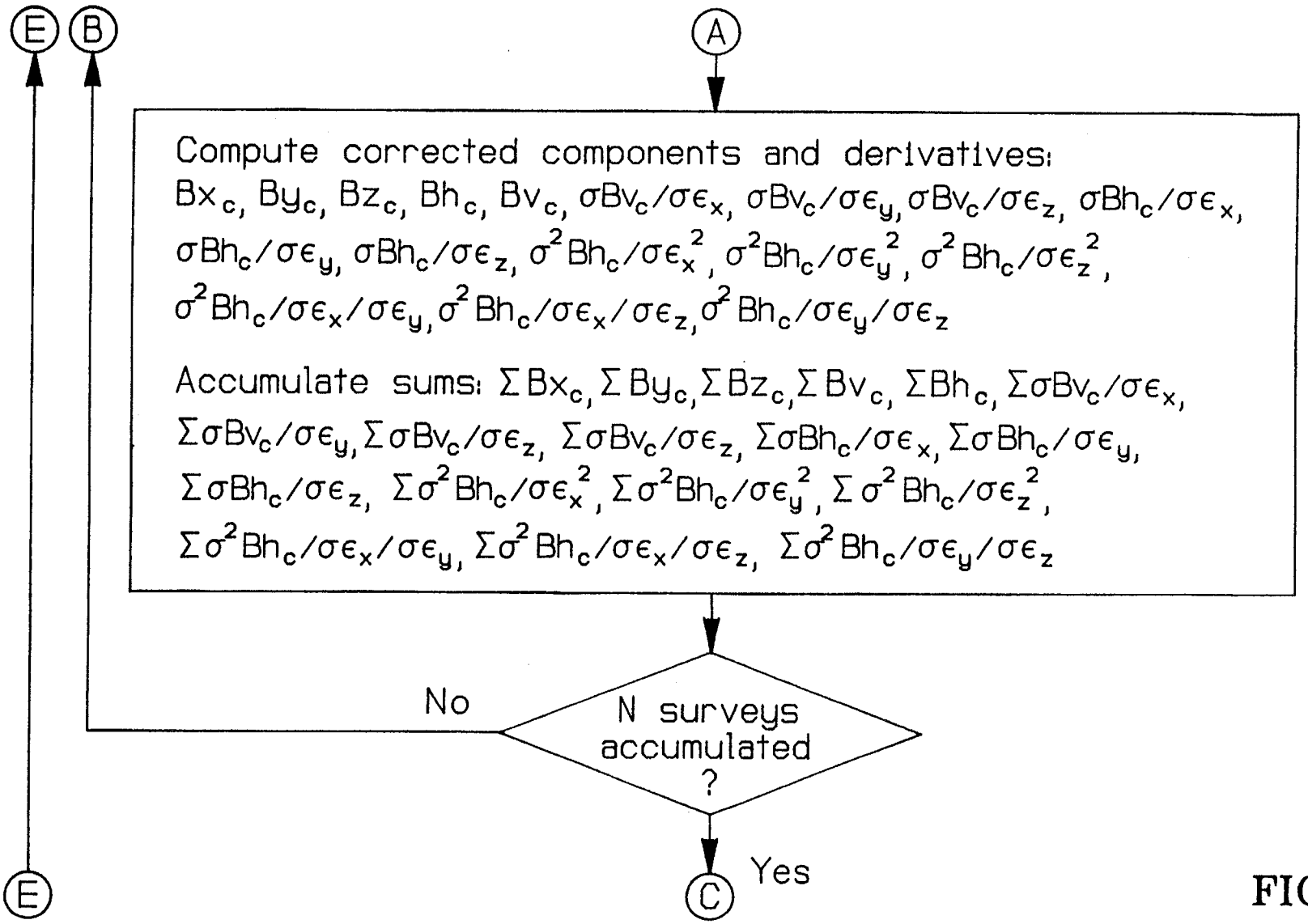
Figure 7C:
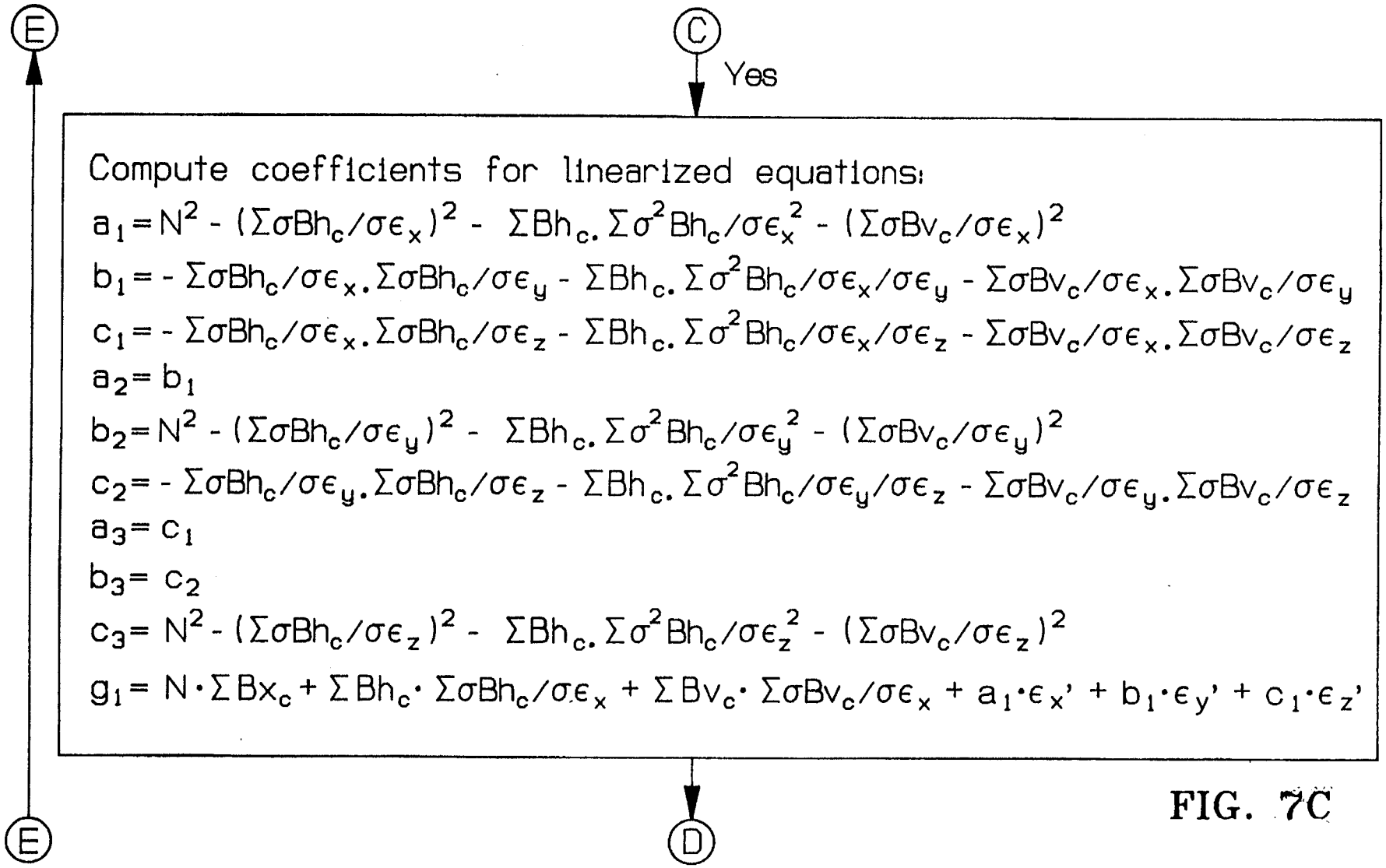
Figure 7D:
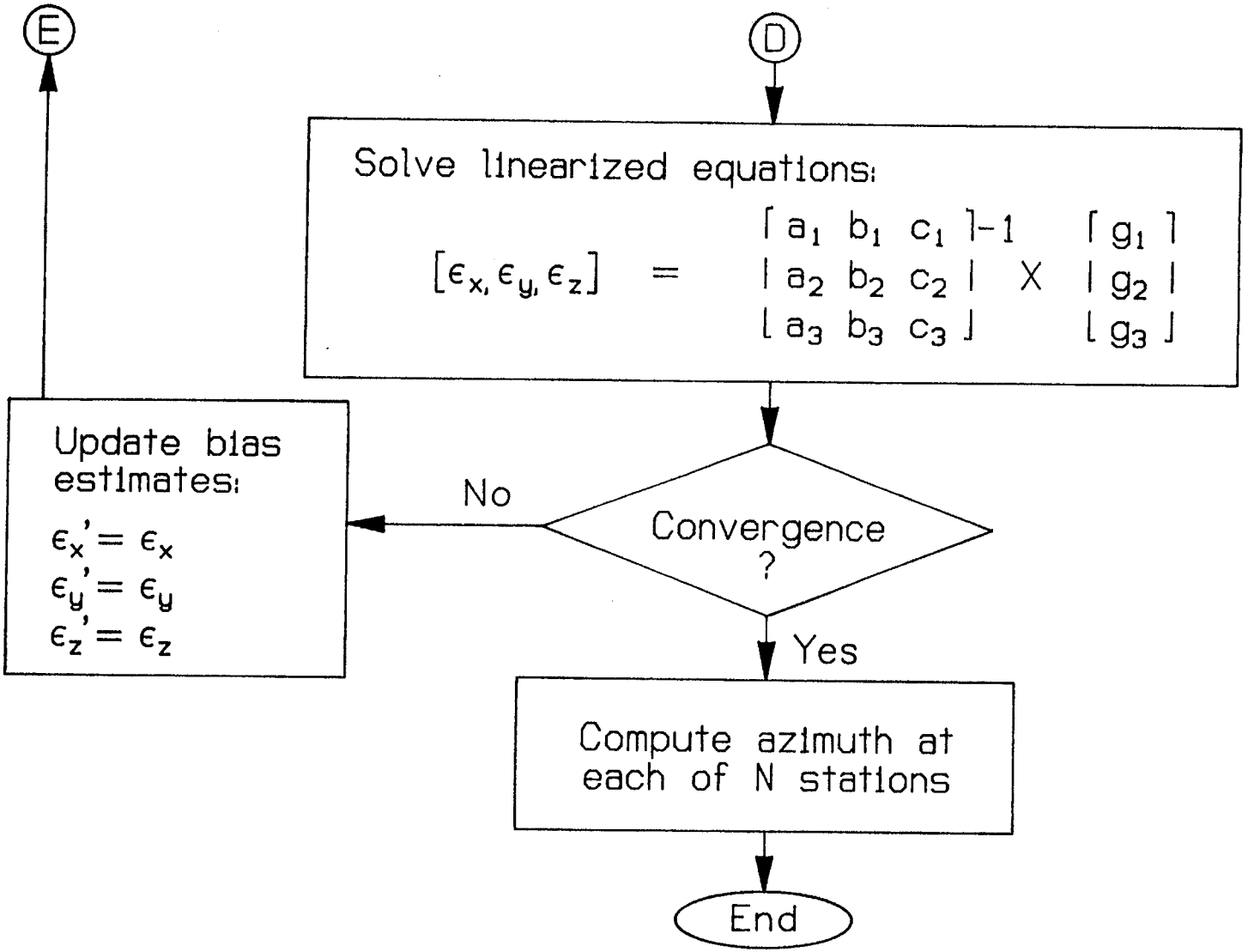

The unknown error components $\epsilon_x$, $\epsilon_y$, and $\epsilon_z$ are small perturbations, and an approximate solution can therefore be found by linearizing the Equations 10 through 12. The linearized form of these equations is:

$$a_1*\epsilon_x+b_1*\epsilon_y+c_1*\epsilon_z=g_1 \tag{13}$$

$$a_2*\epsilon_x+b_2*\epsilon_y c_2*\epsilon_z=g_2 \tag{14}$$

$$a_3*\epsilon_x+b_3*\epsilon_y+c_3*\epsilon_z=g_3 \tag{15}$$

where:

$$a_1=\partial/\partial\epsilon_x[F(\epsilon_x', \epsilon_y', \epsilon_z')] \tag{16}$$

$$b_1=\partial/\partial\epsilon_y]F(\epsilon_x', \epsilon_y')]\epsilon_z')] \tag{17}$$

$$c_1=\partial/\partial\epsilon_z[F(\epsilon_x', \epsilon_y', \epsilon_z')] \tag{18}$$

$$a_2=\partial/\ \partial\epsilon_x[G(\epsilon_x', \epsilon_y', \epsilon_z')] \tag{19}$$

$$b_2=\partial/\partial\epsilon_y[G(\epsilon_x', \epsilon_y', \epsilon_z')] \tag{20}$$

$$c_2=\partial/\partial\epsilon_z[G(\epsilon_x', \epsilon_y', \epsilon_z')] \tag{21}$$

$$a_3=\partial/\partial\epsilon_x[H(\epsilon_x', \epsilon_y', \epsilon_z')] \quad (22)$$

$$b_3=\partial/\partial\epsilon_y[H(\epsilon_x', \epsilon_y', \epsilon_z')] \quad (23)$$

$$c_3=\partial/\partial\epsilon_z[H(\epsilon_x', \epsilon_y', \epsilon_z')] \quad (24)$$

and:

$$g_1=a_1*\epsilon_x'+b_1*\epsilon_y'c_1*\epsilon_z'F(\epsilon_x', \epsilon_y', \epsilon_z') \quad (25)$$

$$g_2=a_2*\epsilon_x'+b_2*\epsilon_y'+c_2*\epsilon_z'-G(\epsilon_x', \epsilon_y', \epsilon_z') \quad (26)$$

$$g_3=a_3*\epsilon_x'+b_3*\epsilon_y'+c_3*\epsilon_z'-H(\epsilon_x', \epsilon_y', \epsilon_z') \quad (27)$$

and the primed error terms $\epsilon_x'$, $\epsilon_y'$, and $\epsilon_z'$ represent the previous estimates of these values. The linearized Equations 13 through 15 can be solved by standard methods for the unknowns $\epsilon_x$, $\epsilon_y$, and $\epsilon_z$, and these solutions can then be refined by further iteration in the loop described by Equations 4 through 15, if necessary. A suitable stopping criterion (or "convergence" criterion) may be used to determine whether further iterations are needed, such as the change in computed values of $\epsilon_x$, $\epsilon_y$, and $\epsilon_z$ falling below a predefined minimum limit, or a specified number of iterations having been performed. Upon completion of the computation, the corrected magnetic vectors are more closely grouped, as illustrated in FIG. 6.

The central values $Bv_0$ and $Bh_0$ may be taken to be either independent constants obtained from an external source, or the mean values $\Sigma Bv_c/N$ and $\Sigma Bh_c/N$, with the latter values preferred in cases where at least some of the surveys are in attitudes approaching horizontal east-west. The various derivatives can be evaluated by use of the chain rule and differentiation of Equations 10 through 12. FIG. 7 illustrates the solution procedure in flowchart form, with the coefficients in equations 16 through 27 expanded for the case where $Bv_0$ and $Bh_0$ are the mean values of the computed vectors.

After determining the biases $\epsilon_x$, $\epsilon_y$, and $\epsilon_z$, the compensated magnetic field components may be found by use of Equations 7 and 8, and compensated values of the borehole azimuth may be found by the use of well-known equations.

The method of obtaining coefficients $a_1$ through $c_3$ will be illustrated through the following examples in which coefficient $a_1$ is computed, as defined by Equation 16. First, in the case where $Bv_0$ and $Bh_0$ are independent constants, Equation 10 can be simplified to:

$$F(\epsilon_x, \epsilon_y, \epsilon_z)=\Sigma[(Bh_c-Bh_0)*\partial Bh_c/\partial\epsilon_x+(Bv_c-Bv_0)*\partial Bv_c/\partial\epsilon_x] \quad (28)$$

Taking the derivative with respect to $\epsilon_x$, $$a_1=\Sigma[(\partial Bh_c/\partial\epsilon_x)^2+(Bh_c-Bh_0)*\partial^2 Bh_c/\partial\epsilon_x^2+(\partial Bv_c/\partial\epsilon_x)^2+(Bv_c-Bv_0)*\partial^2 Bv_c/\partial\epsilon_x^2] \quad (29)$$

This expression can be simplified by use of the following relationships, which follow from Equations 4, 7 and 8:

$$\partial Bx_c/\partial\epsilon_x=-1 \quad (30)$$

$$\partial Bv_c/\partial\epsilon_x=-\partial Bv_c/\partial Bx_c=-G_x/|G| \quad (31)$$

$$\partial Bh_c/\partial\epsilon_x=-(Bx_c+Bv_c*Bv_c/\partial\epsilon_x)/Bh_c \quad (32)$$

$$\partial^2 Bv_c/\partial\epsilon_x^2=0 \quad (33)$$

$$\partial^2 Bh_c/\partial\epsilon_x^2=[1-(\partial Bv_c/\partial\epsilon_x)^2-(\partial Bh_c/\partial\epsilon_x)^2]/Bh_c \quad (34)$$

Substituting these expressions in Equation 29, yields:

$$a_1=\Sigma(1-Bh_0*\partial^2 Bh_c/\partial\epsilon_x^2)=N-Bh_0*\Sigma(\partial^2 Bh_c/\partial\epsilon_x^2) \quad (35)$$

The coefficients become more complicated in the case where the central values $Bv_0$ and $Bh_0$ are not constants, but are instead defined as the means of the $Bv_c$ and $Bh_c$ values. In this case, $$F(\epsilon_x, \epsilon_y, \epsilon_z)=\Sigma[(Bh_c-\Sigma Bh_c/N)*\{\partial Bh_c/\partial\epsilon_x-\Sigma(\partial Bh_c/\partial\epsilon_x)/N\}]+\Sigma[(Bv_c-\Sigma Bv_c/N)*\{\partial Bv_c/\partial\epsilon_x-\Sigma(\partial Bv_c/\partial\epsilon_x)/N\}] \quad (36)$$

which can be simplified to:

$$F(\epsilon_x, \epsilon_y, \epsilon_z)=\Sigma(Bh_c*\partial Bh_c/\partial\epsilon_x)-\Sigma Bh_c*\Sigma(\partial Bh_c/\partial\epsilon_x)/N+\Sigma(Bv_c*\partial Bv_c/\partial\epsilon_x)-\Sigma Bv_c*\Sigma(\partial Bv_c/\partial\epsilon_x)/N \quad (37)$$

Differentiating with respect to $\epsilon_x$, $$a_1=\Sigma(\partial Bh_c/\partial\epsilon_x)^2+\Sigma(Bh_c*\partial^2 Bh_c/\partial\epsilon_x^2)-[\Sigma(\partial Bh_c/\partial\epsilon_x)]^2/N-\Sigma Bh_c*\Sigma(\partial^2 Bh_c/\partial\epsilon_x^2)/N+\Sigma(\partial Bv_c/\partial\epsilon_x)^2+\Sigma(Bv_c*\partial^2 Bv_c/\partial\epsilon_x^2)-[\Sigma(\partial Bv_c/\partial\epsilon_x)]^2/N-\Sigma Bv_c*\Sigma(\partial^2 Bv_c/\partial\epsilon_x^2)/N \quad (38)$$

and simplifying using Equations 30 through 34:

$$a_1=N-[\Sigma(\partial Bh_c/\partial\epsilon_x)]^2/N-[\Sigma(\partial Bv_c/\partial\epsilon_x)]^2/N-\Sigma Bh_c*\Sigma(\partial^2 Bh_c/\partial\epsilon_x^2)/N \quad (39)$$

Similar calculations may be used to find the remaining coefficients. The results are given in FIG. 7, wherein each coefficient has been multiplied by N to simplify further.

Figure 8:
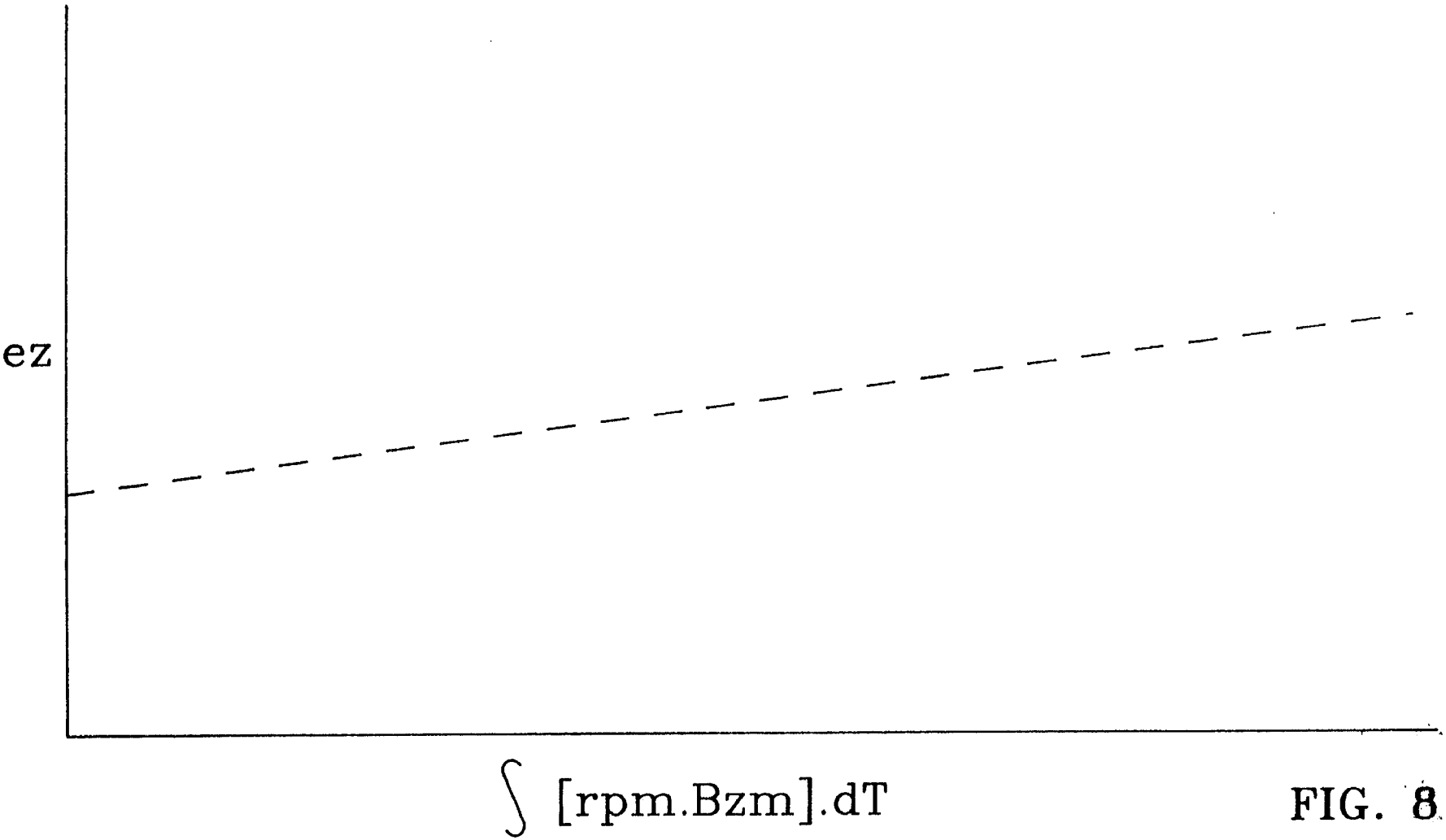
FIG. 8 shows a bias error which is assumed to vary as a function of drillstring revolutions and approximate axial magnetic component.

It is commonly believed that drillstring magnetization results from repeated mechanical strains applied to ferromagnetic portions of the drillstring in the presence of the earth's magnetic field, during the drilling operation. It is therefore possible for the drillstring magnetization to change slowly during the course of the drilling operation. Such a change might reasonably be approximated by a linear change over time, or by an amount proportional to strain history as measured by accumulated drillstring revolutions, or by a function including the approximate or uncompensated magnetic field along the magnetometer axis, or by functions of these and other quantities which can be determined in advance of the computation. The present invention therefore includes a further method for computing magnetic bias errors which are first-order functions of known or measured parameters. For example, FIG. 8 illustrates a case wherein the axial magnetometer bias is assumed to vary as a linear function of the accumulated product of drillstring rotations and the axial component of the magnetic vector.

To solve for bias errors which are assumed to vary as linear functions of known parameters $P_x$, $P_y$, and $P_z$, the bias errors are represented as:

$$\epsilon_x=m_{\epsilon x}*P_x+\epsilon_{x0} \quad (40)$$

$$\epsilon_y=m_{\epsilon y}*P_y+\epsilon_{y0} \quad (41)$$

$$\epsilon_z=m_{\epsilon z}*P_z+\epsilon_{z0} \quad (42)$$

in which the six unknowns are the slopes $m_{\epsilon x}$, $m_{\epsilon y}$, and $m_{\epsilon z}$, and the intercepts $\epsilon_{x0}$, $\epsilon_{y0}$, and $\epsilon_{z0}$. Differentiation must now be performed with respect to these unknowns, thus the iterative portion of the computation must now solve the following equations:

$$F(\epsilon_x, \epsilon_y, \epsilon_z)=\Sigma[(Bh_c-Bh_0)*(\partial Bh_c/\partial\epsilon_x-\partial Bh_0/\partial\epsilon_x)+(Bv_c-Bv_0)*(\partial Bv_c/\partial\epsilon_x-\partial Bv_0/\partial\epsilon_x)]=0 \quad (10)$$

$$G(\epsilon_x, \epsilon_y, \epsilon_z)=\Sigma[(Bh_c-Bh_0)*(\partial Bh_c/\partial\epsilon_y-\partial Bh_0/\partial\epsilon_y)+(Bv_c-Bv_0)*(\partial Bv_c/\partial\epsilon_y-\partial Bv_0/\partial\epsilon_y)]=0 \quad (11)$$

$$H(\epsilon_x, \epsilon_y, \epsilon_z)=\Sigma[(Bh_c-Bh_0)*(\partial Bh_c/\partial\epsilon_z-\partial Bh_0/\partial\epsilon_z)+(Bv_c-Bv_0)*(\partial Bv_c/\partial\epsilon_z-\partial Bv_0/\partial\epsilon_z)]=0 \quad (12)$$

$$I(\epsilon_x, \epsilon_y, \epsilon_z)=\Sigma[(Bh_c-Bh_0)*P_x*(\partial Bh_c/\partial\epsilon_x-\partial Bh_0/\partial\epsilon_x)+(Bv_c-$$

$$Bv_0)*P_x*(\partial Bv_c/\partial\epsilon_x-\partial Bv_0/\partial\epsilon_x)]=0 \quad (43)$$

$$J(\epsilon_x, \epsilon_y, \epsilon_z)=\Sigma[(Bh_c-Bh_0)*P_y*(\partial Bh_c/\partial\epsilon_y-\partial Bh_0/\partial\epsilon_y)+(Bv_c-Bv_0)*P_y*(\partial Bv_c/\partial\epsilon_y-\partial Bv_0/\partial\epsilon_y)]=0 \quad (44)$$

$$K(\epsilon_x, \epsilon_y, \epsilon_z)=\Sigma[(Bh_c-Bh_0)*P_z*(\partial Bh_c/\partial\epsilon_z-\partial Bh_0/\partial\epsilon_z)+(Bv_c-Bv_0)*P_z*(\partial Bv_c/\partial\epsilon_z-\partial Bv_0/\partial\epsilon_z)]=0 \quad (45)$$

where Equations 10 through 12 are obtained by differentiation of Equation 9 with respect to the unknown intercepts $\epsilon_{x0}$, $\epsilon_{y0}$, and $\epsilon_{z0}$, and Equations 43 through 45 are obtained by differentiation with respect to the unknown slopes $m_{\epsilon x}$, $m_{\epsilon y}$, and $m_{\epsilon z}$. Improved estimates of the six unknowns can be found by solving the six linearized equations:

$$a_1*e_{x0}+b_1*e_{y0}+c_1*e_{z0}+d_1*m_{\epsilon x}+e_1*m_{\epsilon y}+f_1*m_{\epsilon z}=g_1 \quad (46)$$

$$a_2*e_{x0}+b_2*e_{y0}+c_2*e_{z0}+d_2*m_{\epsilon x}+e_2*m_{\epsilon y}+f_2*m_{\epsilon z}=g_2 \quad (47)$$

$$a_3*e_{x0}+b_3*e_{y0}+c_3*e_{z0}+d_3*m_{\epsilon x}+e_3*m_{\epsilon y}+f_3*m_{\epsilon z}=g_3 \quad (48)$$

$$a_4*e_{x0}+b_4*e_{y0}+c_4*e_{z0}+d_4*m_{\epsilon x}+e_4*m_{\epsilon y}+f_4*m_{\epsilon z}=g_4 \quad (49)$$

$$a_5*e_{x0}+b_5*e_{y0}+c_5*e_{z0}+d_5*m_{\epsilon x}+e_5*m_{\epsilon y}+f_5*m_{\epsilon z}=g_5 \quad (50)$$

$$a_6*e_{x0}+b_6*e_{y0}+c_6*e_{z0}+d_6*m_{\epsilon x}+e_6*m_{\epsilon y}+f_6*m_{\epsilon z}=g_6 \quad (51)$$

in which the coefficients are defined as follows:

$$a_1=\partial/\partial\epsilon_{x0}[F(\epsilon_x', \epsilon_y', \epsilon_z')] \quad (52)$$

$$b_1=\partial/\partial\epsilon_{y0}[F(\epsilon_x', \epsilon_y', \epsilon_z')] \quad (53)$$

$$c_1=\partial/\partial\epsilon_{z0}[F(\epsilon_x', \epsilon_y', \epsilon_z')] \quad (54)$$

$$d_1=\partial/\partial m_{\epsilon x}[F(\epsilon_x', \epsilon_y', \epsilon_z')] \quad (55)$$

$$e_1=\partial/\partial m_{\epsilon y}[F(\epsilon_x', \epsilon_y', \epsilon_z')] \quad (56)$$

$$f_1=\partial/\partial m_{\epsilon z}[F(\epsilon_x', \epsilon_y', \epsilon_z')] \quad (57)$$

and coefficients $a_2$ through $f_6$ are obtained similarly, by differentiation of functions $G(\epsilon_x, \epsilon_y, \epsilon_z)$ through $K(\epsilon_x, \epsilon_y, \epsilon_z)$, and $$g_1=a_1*\epsilon_{x0}'+b_1*\epsilon_{y0}'+c_1*\epsilon_{z0}'+d_1*m_{\epsilon x}'+e_1*m_{\epsilon y}'+f_1*m_{\epsilon z}'-F(\epsilon_x', \epsilon_y', \epsilon_z') \quad (58)$$

$$g_2=a_2*\epsilon_{x0}'+b_2*\epsilon_{y0}'+c_2*\epsilon_{z0}'+d_2*m_{\epsilon x}'+e_2*m_{\epsilon y}'+f_2*m_{\epsilon z}'-G(\epsilon_x', \epsilon_y', \epsilon_z') \quad (59)$$

$$g_3=a_3*\epsilon_{x0}'+b_3*\epsilon_{y0}'+c_3*\epsilon_{z0}'+d_3*m_{\epsilon x}'+e_3*m_{\epsilon y}'+f_3*m_{\epsilon z}'-H(\epsilon_x', \epsilon_y', \epsilon_z') \quad (60)$$

$$g_4=a_4*\epsilon_{x0}'+b_4*\epsilon_{y0}'+c_4*\epsilon_{z0}'+d_4*m_{\epsilon x}'+e_4*m_{\epsilon y}'+f_4*m_{\epsilon z}'-I(\epsilon_x', \epsilon_y', \epsilon_z') \quad (61)$$

$$g_5=a_5*\epsilon_{x0}'+b_5*\epsilon_{y0}'+c_5*\epsilon_{z0}'+d_5*m_{\epsilon x}'+e_5*m_{\epsilon y}'+f_5*m_{\epsilon z}'-J(\epsilon_x', \epsilon_y', \epsilon_z') \quad (62)$$

$$g_6=a_6*\epsilon_{x0}'+b_6*\epsilon_{y0}'+c_6*\epsilon_{z0}'+d_6*m_{\epsilon x}'+e_6*m_{\epsilon y}'+f_6*m_{\epsilon z}'-K(\epsilon_x', \epsilon_y', \epsilon_z') \quad (63)$$

After determining the various slopes and intercepts by solving the set of linearized equations, new estimates of the biases can be made at each survey station using equations 28 through 30, and these improved estimates can be used in further iteration as required.

Although the invention has been described in detail in forms wherein the unknown biases are either all constant or all varying as functions of known parameters, it will be understood by those skilled in the art that the invention may also be used to solve for biases of mixed character; for example, some biases constant and others varying, some biases zero and others varying, or some biases zero and others constant. This can be understood by reference to Equations 46 through 51, which represent the general case of six linearized equations with six unknowns. Reduction of one bias from variable to constant reduces the number of unknowns by one since the previously unknown slope is now known to be zero, and it reduces the number of equations by one because the row of coefficients obtained by differentiation with respect to the slope may be eliminated. Similarly, reduction of one bias from constant to zero will also reduce the number of unknowns and equations by one. In particular, if the three slopes are set to zero, the six Equations 46 through 51 reduce to the three Equations 13 through 15 which can be solved for constant biases.

Preferably, the techniques of the present invention are utilized in wellbore surveying operations. As is conventional, the measurements are transmitted to the earth's surface utilizing measurement-while-drilling data transmission techniques. These data may be entered into a computing device which is preprogrammed in accordance with the method of the present invention. The program will include as inputs the x-axis, y-axis and z-axis components of the local magnetic and gravitational field vectors at each survey station. The calculations are performed in accordance with the description provided hereinabove, and the program provides as an output for each survey station the wellbore's azimuth and inclination which are so useful in defining the position of a wellbore.

While the invention has been shown in only certain forms, it is not thus limited but is susceptible to various changes and modifications without departing from the spirit thereof.

What is claimed is:

1. A method of surveying in a wellbore, comprising the method steps of:

(a) providing a drillstring;

(b) providing a sensor array including magnetic field sensors and gravitational field sensors;

(c) locating said sensor array within said drillstring;

(d) locating said drillstring in said wellbore;

(e) utilizing said drillstring to extend said wellbore;

(f) at a number of survey stations within said wellbore, utilizing said sensor array to make measurements of (a) three components of gravitational field, and (b) three components of magnetic field, with each of said three components of magnetic field possibly including a magnetic field bias error component;

(g) communicating said measurements to a processor which is programmed to execute a set of program instructions, including:

(i) instruction means for selecting for said number of survey stations within said wellbore, an initial estimate for said magnetic field bias error component for particular ones of said three components of magnetic field;

(ii) instruction means for computing, for each survey station within said wellbore, corrected values for said three components of magnetic field utilizing said initial estimate for said magnetic field bias error component for particular ones of said three components of magnetic field;

(iii) instruction means for computing, for each survey station within said wellbore a corrected magnetic field vector utilizing said corrected values for said three components of magnetic field;

(iv) instruction means for computing an improved estimate for said magnetic field bias error component for particular ones of said three components of magnetic field;

(h) establishing a preselected convergence criterion for said corrected magnetic field vector;

(i) iteratively executing said set of program instructions in order to generate, for each survey station within said wellbore, a corrected magnetic field vector which satisfies said preselected convergence criterion and which minimizes the variance of said corrected magnetic field vector with respect to a predetermined value; and thereby (j) providing substantially corrected magnetic field measurements for each survey station within said wellbore.

2. A method of surveying in a wellbore according to claim 1, further comprising:

(k) utilizing said instruction means for selecting and supplying, for each survey station within said wellbore, an initial estimate for said magnetic field bias error component for particular ones of said three components of magnetic field which is at least partially based upon a magnetic field bias error component determined from at least one preceding survey station.

3. A method of surveying in a wellbore according to claim 1, further comprising:

(k) utilizing said measurements of said three components of gravitational field and said substantially corrected magnetic field measurements to calculate at least one wellbore orientation indicator.

4. A method of surveying in a wellbore according to claim 3, wherein said at least one wellbore orientation indicator includes wellbore azimuth.

5. A method of surveying in a wellbore according to claim 1, further comprising:

(k) deriving said predetermined value from an independent estimate of earth's magnetic field.

6. A method of surveying in a wellbore according to claim 1, further comprising:

(k) deriving said predetermined value from a plurality of previous calculations of corrected magnetic field vector.

7. A method of surveying in a wellbore according to claim 1, further comprising:

(k) deriving said predetermined value from an averaging of a plurality of previous calculations of corrected magnetic field vectors.

8. A method of surveying in a wellbore according to claim 1:

wherein said step of establishing a preselected convergence criterion comprises establishing a preselected minimum variance for said corrected magnetic field vector for each survey station;

wherein said step of iteratively executing comprises:

iteratively executing said set of program instructions in order to generate, for each survey station within said wellbore, a corrected magnetic field vector which satisfies said preselected minimum variance and which minimizes the variance of said corrected magnetic field vector with respect to a central value.

9. A method of surveying in a wellbore according to claim 1:

wherein said step of establishing a preselected convergence criterion comprises establishing a preselected number of iterations for calculation of said corrected magnetic field vectors for each survey station;

wherein said step of iteratively executing comprises:

iteratively executing said set of program instructions in order to generate, for each survey station within said wellbore, a corrected magnetic field vector in a manner which satisfies said preselected number of iterations.

10. A method of surveying in a wellbore according to claim 1, further comprising:

determining at least one linear relationship between a parameter and said magnetic field bias error component for at least one of said three components of magnetic field; and including in said set of program instructions means for developing an improved estimate for said magnetic field bias error component which utilizes said at least one linear relationship.

11. A method for determining bias errors affecting magnetometers used in borehole surveying, comprising the steps of:

a) measuring three components of the gravitational field and three components of the local magnetic field at a number of survey stations;

b) selecting initial estimates for said bias errors;

c) computing corrected magnetic field components by use of said estimated bias errors;

d) using said corrected magnetic field components to compute a corrected magnetic field vector for each of said survey stations;

e) computing improved estimates of said magnetometer bias errors which minimize variance of said magnetic vectors with respect to a central value; and f) iteratively repeating steps c) through e) using said improved estimates, until a defined convergence criterion is met.

12. The method of claim 11 wherein said bias errors comprise a single constant bias error along the magnetometer axis parallel to the drillstring.

13. The method of claim 11 wherein said bias errors comprise constant bias errors along all three magnetometer axes.

14. The method of claim 11 wherein said bias errors comprise a single bias error which varies as a defined function of known quantities, along the magnetometer axis parallel to the drillstring.

15. The method of claim 11 wherein said bias errors comprise bias errors which vary as defined functions of known quantities, along all three magnetometer axes.

16. The method of claim 11 wherein said bias errors comprise two constant bias errors along the transverse magnetometer axes, and a single bias error which varies as a defined function of known quantities along the magnetometer axis parallel to the drillstring.

17. The method of claim 11 wherein said central value is obtained from an independent estimate of the earth's magnetic field.

18. The method of claim 11 wherein said central value is obtained from the mean values of said corrected magnetic field vectors.

19. The method of claim 11 wherein said convergence criterion consists of determining whether the change in bias error between successive iteration exceeds a predefined minimum limit.

20. The method of claim 11 wherein said convergence criterion consists of performing a predefined number of iterations.

21. The method of claim 11 wherein borehole azimuth at one or more of said survey stations is determined from said components of the gravitational field and said corrected magnetic field components.

* * * * *